US007213588B2

(12) United States Patent
Iwa et al.

(10) Patent No.: US 7,213,588 B2
(45) Date of Patent: May 8, 2007

(54) IGNITION DEVICE FOR INTERNAL COMBUSTION ENGINE

(75) Inventors: Masahiro Iwa, Tokyo (JP); Shigemi Murata, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/202,354

(22) Filed: Aug. 12, 2005

(65) Prior Publication Data

US 2006/0260591 A1 Nov. 23, 2006

(30) Foreign Application Priority Data

May 19, 2005 (JP) ..... 2005-146994

(51) Int. Cl.
*F02P 7/02* (2006.01)
*F02P 15/00* (2006.01)
*H01F 38/12* (2006.01)

(52) U.S. Cl. ..... 123/633; 123/634; 336/96

(58) Field of Classification Search ..... 123/633, 123/634, 635; 336/96, 107
See application file for complete search history.

(56) References Cited

U.S. PATENT DOCUMENTS 4,224,554 A * 9/1980 Nishio et al. ..... 123/633
6,501,360 B2 * 12/2002 Martagni et al. ..... 336/96
7,036,495 B1 * 5/2006 Shimizu ..... 123/633

FOREIGN PATENT DOCUMENTS

JP 2003-243234 A * 8/2003
JP 2004-232466 A 8/2004

* cited by examiner

*Primary Examiner*—Stephen K. Cronin
*Assistant Examiner*—Arnold Castro
(74) *Attorney, Agent, or Firm*—Sughrue Mion, PLLC

(57) ABSTRACT

To provide an ignition device for an internal combustion engine which for example prevents a crack from being made in a cast insulating resin or a transformer output voltage control element from being damaged. The ignition device for an internal combustion engine of the present invention includes: a transformer (2); a case (3) that is composed of a case body (3*a*) receiving the transformer (2), and a high-tension tower (3*b*) having an opening portion (5); a cast insulating resin (4) that is injected into the case body (3*a*) and cured and thus insulates and fixes the transformer (2); a high-voltage connection terminal (7) that closes the opening portion (5) such that the cast insulating resin (4) that has not been cured is prevented from entering the high-tension tower (3*b*); a noise-suppressing resister (8) that is received in the high-tension tower (3*b*), is electrically connected to the high-voltage connection terminal (7), and controls a voltage generated in the second winding in activating the transformer (2); and a spring (14) that electrically connects the noise-suppressing resister (8) and a spark plug to each other, and urges the noise-suppressing resister (8) toward the high-voltage connection terminal (7).

14 Claims, 8 Drawing Sheets

IGNITION DEVICE FOR INTERNAL COMBUSTION ENGINE

BACKGROUND OF THE INVENTION

1. Field of the Invention

The present invention relates to an ignition device for an internal combustion engine which is provided with a transformer output voltage control element that is arranged inside a high-tension tower and electrically connected to a high-voltage connection terminal and controls a voltage generated in a secondary winding in activating a transformer.

2. Description of Related Art

Conventionally, in an ignition device for an internal combustion engine disclosed, for example, in JP 2004-232466 A (FIG. 1, paragraph 0011), a noise-suppressing resistor 8 disposed in a high-tension cylinder 7 is connected at one end thereof to a high-voltage terminal 6 and at the other end thereof to a coil spring 23 which is electrically connected to an apex terminal 23. A cast insulating resin 5, which is injected into a case 4 so as to insulate and fix a transformer, is cured, whereby the noise-suppressing resistor 8 is held electrically connected to the high-voltage terminal 6 in the high-tension cylinder 7.

The noise-suppressing resistor 8 is, generally, constructed by connecting and fixing electrodes to both ends of a ceramic resistor respectively, and is used for the purpose of preventing electrical noise generated at the time of a spark discharge of the ignition plug 32 from affecting peripheral electronic components.

In the aforementioned ignition device for the internal combustion engine, however, the noise-suppressing resistor 8 and the high-voltage terminal 6 are fixed by the cast insulating resin 5 so as to prevent abrasion from being caused between the noise-suppressing resistor 8 and the high-voltage terminal 6 due to, for example, engine vibration. Thus, there have been problems in that a crack is made in the cast insulating resin 5 as a result of a difference in coefficient of linear expansion arising between the cast insulating resin 5 made of an epoxy resin and the noise-suppressing resistor 8 made of a ceramic, and the noise-suppressing resistor 8 is damaged by a thermal stress ascribable to the cast insulating resin 5.

There has also been a problem in that the noise-suppressing resistor 8 and the high-voltage terminal 6 must be electrically connected to each other through an operation in advance of injecting the cast insulating resin 5 into the case 4 with a view to preventing the noise-suppressing resistor 8 and the high-voltage terminal 6 from being brought out of electrical contact with each other due to the interposition of the cast insulating resin 5.

Further, since the cast insulating resin 5 is interposed between the noise-suppressing resistor 8 and the high-voltage terminal 6, there is also a problem in that the noise-suppressing resistor 8 is not easily replaceable alone in the market.

SUMMARY OF THE INVENTION

The present invention has been made to solve the problems described above, and has an object to obtain an ignition device for an internal combustion engine which prevents a crack from being made in a cast insulating resin or a transformer output voltage control element from being damaged, facilitates an operation of electrically connecting the transformer output voltage control element to a high-voltage output terminal after the cast insulating resin has been fixed, and further makes the transformer output voltage control element easily replaceable in the market.

An ignition device for an internal combustion engine according to the present invention includes: a transformer having a primary winding and a secondary winding; a case composed of a case body receiving the transformer, and a high-tension tower having an opening portion, the case body and the high-tension tower communicating with each other through the opening portion; a cast insulating resin injected into the case body and cured to insulate and fix the transformer; a high-voltage connection terminal connected to one end of the secondary winding, which closes the opening portion so that the cast insulating resin that has not been cured is prevented from entering the high-tension tower; a transformer output voltage control element received in the high-tension tower, which is electrically connected to the high-voltage connection terminal, and controls a voltage generated in the second winding in activating the transformer; and a spring provided between the transformer output voltage control element and a spark plug, which electrically connects the transformer output voltage control element and the spark plug to each other, and urges the transformer output voltage control element toward the high-voltage connection terminal.

The ignition device for the internal combustion engine according to the present invention prevents a crack from being made in the cast insulating resin or the transformer output voltage control element from being damaged, facilitates the operation of electrically connecting the transformer output voltage control element to the high-voltage output terminal after the cast insulating resin has been fixed, and further makes the transformer output voltage control element easily replaceable.

DETAILED DESCRIPTION OF PREFERRED EMBODIMENTS

Figure 1:
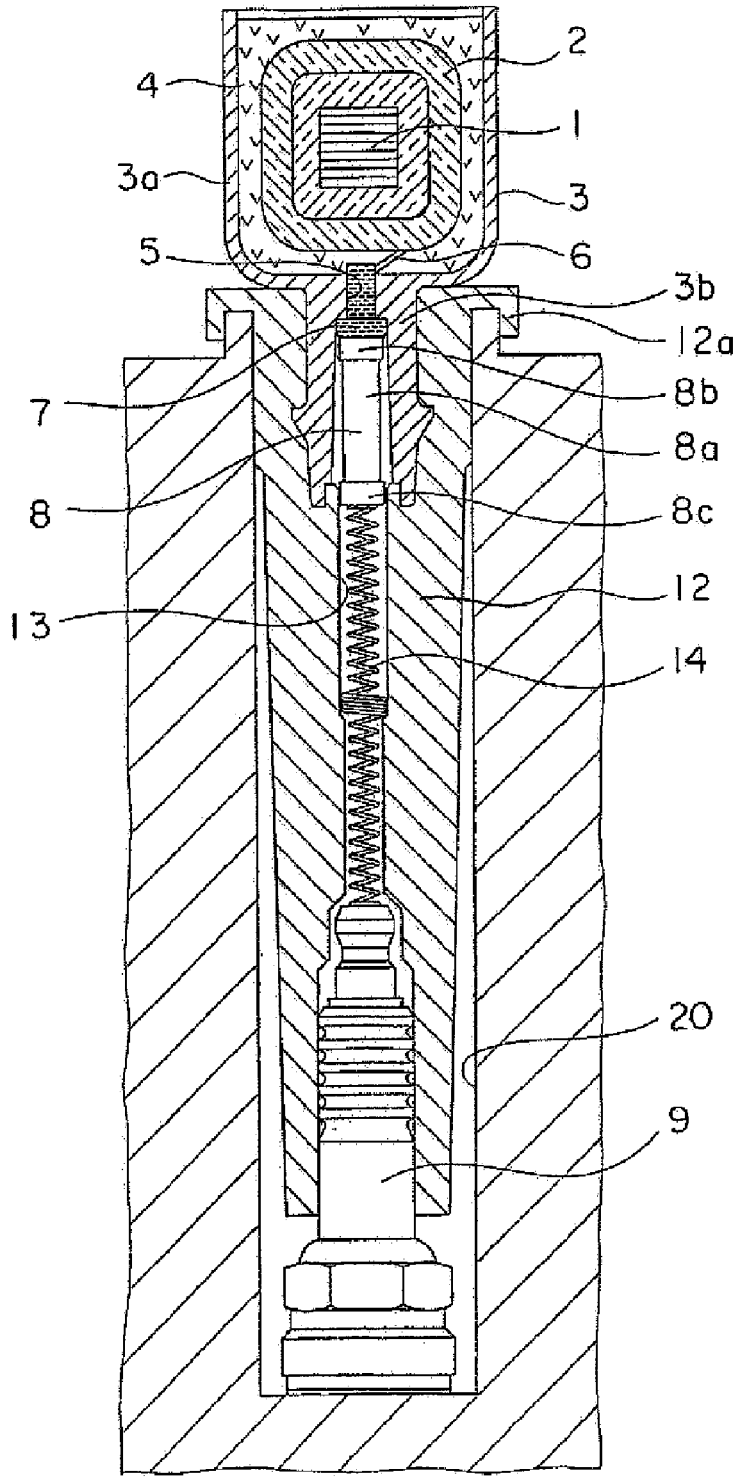
FIG. 1 is a cross-sectional view showing an ignition device for an internal combustion engine according to a first embodiment of the present invention.

Respective embodiments of the present invention will be described herein after by referring to the drawings. In the following description, like or equivalent components or portions are denoted by the same reference symbols.

First Embodiment

FIG. 1 is a cross-sectional view showing an ignition device for an internal combustion engine according to a first embodiment of the present invention.

In this ignition device for the internal combustion engine, a transformer 2, which is obtained by winding a primary winding and a secondary winding around a core 1, is disposed in a case 3. The case 3 is composed of a case body 3*a* and a high-tension tower 3*b*. The case body 3*a* contains the transformer 2 that is insulated and fixed by a cast insulating resin 4. The high-tension tower 3*b* is formed integrally with the case body 3*a* and has an opening portion 5 communicating with the case body 3*a*.

The opening portion 5 of the high-tension tower 3*b* is provided with a high-voltage connection terminal 7, which is electrically connected to a connection wire 6 of the secondary winding, in such a manner as to close the opening portion 5. A noise-suppressing resistor 8, which restrains electrical noise ascribable to a spark discharge caused by a spark plug 9 from affecting peripheral electronic components, is arranged inside the high-tension tower 3*b*. The noise-suppressing resistor 8, which is a transformer output voltage control element for controlling a voltage generated in the secondary winding in activating the transformer 2, is composed of a columnar ceramic body 8*a* and electrodes 8*b* and 8*c* that are constructed as metal caps covering both end portions of the body 8*a* respectively. The electrode 8*b* of the noise-suppressing resistor 8 is in face-to-face contact with a tip face of the high-voltage connection terminal 7, which has a T-shaped cross-section.

A rubber plug boot 12 is fittingly attached to the high-tension tower 3*b* side of the case 3. A through-hole 13 is formed in the plug boot 12 along its central axis. A spring 14, which electrically connects the spark plug 9 to the noise-suppressing resistor 8 and urges the noise-suppressing resistor 8 toward the high-voltage connection terminal 7, is provided in the through-hole 13.

Next, a procedure of manufacturing the ignition device for the internal combustion engine constructed as described above will be described.

First, the opening portion 5 of the high-tension tower 3*b* is closed by the high-voltage connection terminal 7.

Then, the transformer 2 is mounted in the case body 3*a*. In this process, the connection line 6 of the transformer 2 is electrically connected to the high-voltage connection terminal 7.

After that, the cast insulating resin 4 that is an epoxy resin is injected into the case body 3*a* and cured, so that the transformer 2 is insulated and fixed in the case body 3*a*.

Finally, the noise-suppressing resistor 8 is inserted from the other side of the opening portion 5 of the high-tension tower 3*b*, and subsequently, the plug boot 12 that accommodates the spring 14 in the through-hole 13 is mounted to the high-tension tower 3*b*.

By inserting the plug boot 12 for the ignition device for the internal combustion engine into a plug hole 20 of the engine, the spark plug 9 is inserted into a tip portion of the plug boot 12. As a result, the noise-suppressing resistor 8 is reliably in face-to-face contact with the high-voltage connection terminal 7 due to an elastic force of the contracted spring 14, and the high-voltage connection terminal 7 and the spark plug 9 are reliably electrically connected to each other via the spring 14.

When the ignition device for the internal combustion engine is mounted to the engine by inserting the plug boot 12 into the plug hole 20, a flange 12*a* of the plug boot 12 is sandwiched between the case body 3*a* and the engine. Thus, the plug boot 12 is prevented from falling off due to engine vibration.

According to the ignition device for the internal combustion engine in this embodiment, the high-voltage connection terminal 7 closes the opening portion 5 of the high-tension tower 3*b*. Thus, the cast insulating resin 4 that has not been cured is prevented from entering the high-tension tower 3*b* during a manufacturing process, and the noise-suppressing resistor 8 is prevented from receiving a thermal stress from the cast insulating resin 4, leading to an increase in reliability.

By inserting the plug boot 12 into the plug hole 20 of the engine and inserting the spark plug 9 into the tip portion of the plug boot 12, the elastic force of the spring 14 is generated. Accordingly, owing to the elastic force, the noise-suppressing resistor 8 is reliably in face-to-face contact with the high-voltage connection terminal 7 and is electrically connected to the high-voltage terminal 7 with ease. Thus, an improvement in assembling operation is achieved in comparison with a case of the conventional ignition device that requires electric connection between the noise-suppressing resistor and the high-voltage terminal in advance of casting the insulating resin.

When the noise-suppressing resistor 8 needs to be replaced, for example, in the market, it can be easily replaced after drawing the plug boot 12 out from the plug hole 20 of the engine and drawing the high-tension tower 3*b* out from the plug boot 12.

Second Embodiment

Figure 2:
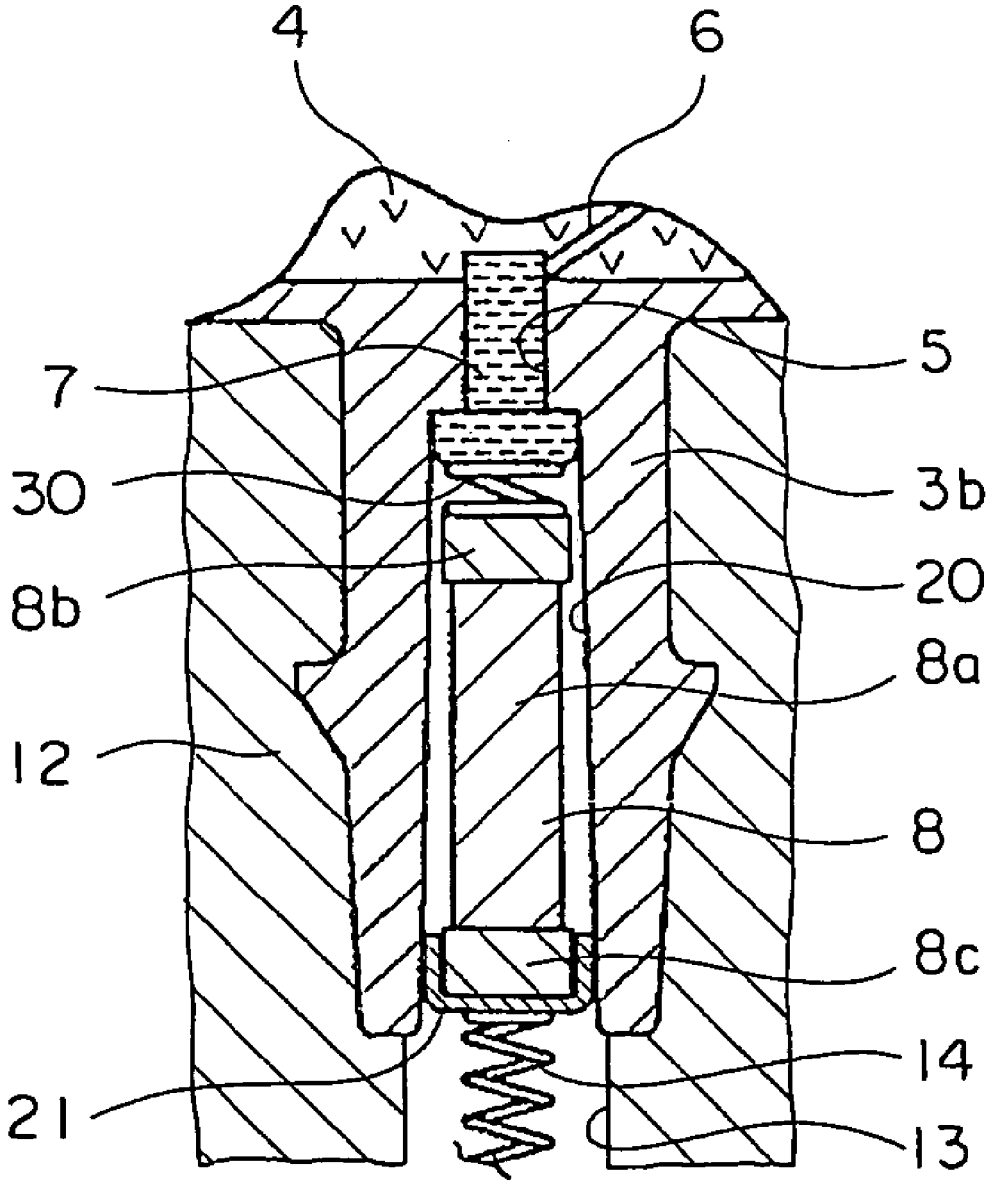
FIG. 2 is a cross-sectional view showing an essential part of an ignition device for an internal combustion engine according to a second embodiment of the present invention.

FIG. 2 is a cross-sectional view showing an essential part of an ignition device for an internal combustion engine according to a second embodiment of the present invention.

In this embodiment, an iron conductive cap 21, which prevents the noise-suppressing resistor 8 from falling off from the high-tension tower 3*b* and abuts on an end portion of the spring 14, is press-fitted into an end portion of the high-tension tower 3*b* on the other side of the opening portion 5. The conductive cap 21 assumes a cylindrical shape with a closed bottom and has an inner diameter dimension that is slightly larger than an outer diameter dimension of the electrode 8*c* of the noise-suppressing resistor 8.

An auxiliary spring 30 urging the noise-suppressing resistor 8 toward the conductive cap 21 is provided between the electrode 8*b* of the noise-suppressing resistor 8 and the high-voltage connection terminal 7.

The ignition device for the internal combustion engine according to the second embodiment is similar to that of the first embodiment in terms of other constructional details.

In the ignition device for the internal combustion engine according to this embodiment, after the auxiliary spring 30 constructed as a coil spring has been inserted into the high-tension tower 3*b* from the other side of the opening portion 5 thereof and the noise-suppressing resistor 8 has been inserted thereinto, the conductive cap 21 is press-fitted into and fixed to the end portion of the high-tension tower 3*b*.

Thus, while a series of operations are performed before insertion of the high-tension tower 3*b* into the plug boot 12 or when the high-tension tower 3*b* is drawn out from the plug boot 12 in a manufacturing process of an ignition coil for an internal combustion engine, there is no fear that the noise-suppressing resistor 8 will be damaged after, for example, falling off by mistake. Consequently, the ignition device of the second embodiment is easier to handle than that of the first embodiment.

The inner diameter dimension of the conductive cap 21 is slightly larger than the outer diameter dimension of the electrode 8*c* of the noise-suppressing resistor 8, which is radially freely movable slightly with respect to the conductive cap 21. Accordingly, when the high-tension tower 3*b* receives an impact from outside in, for example, press-fitting the conductive cap 21 into the end portion of the high-tension tower 3*b* or mounting the high-tension tower 3*b* to the plug boot 12, the impact is restrained from being directly transmitted to the noise-suppressing resistor 8. The magnitude of damage to the noise-suppressing resistor 8 resulting from the impact is reduced.

The extensible auxiliary spring 30 ensures electric connection between the high-voltage connection terminal 7 and the noise-suppressing resistor 8.

The auxiliary spring 30 may be constructed as, for example, a leaf spring instead of the coil spring.

Alternatively, the conductive cap 21 may be fixed to the end portion of the high-tension tower 3*b* using an adhesive.

Third Embodiment

Figure 3:
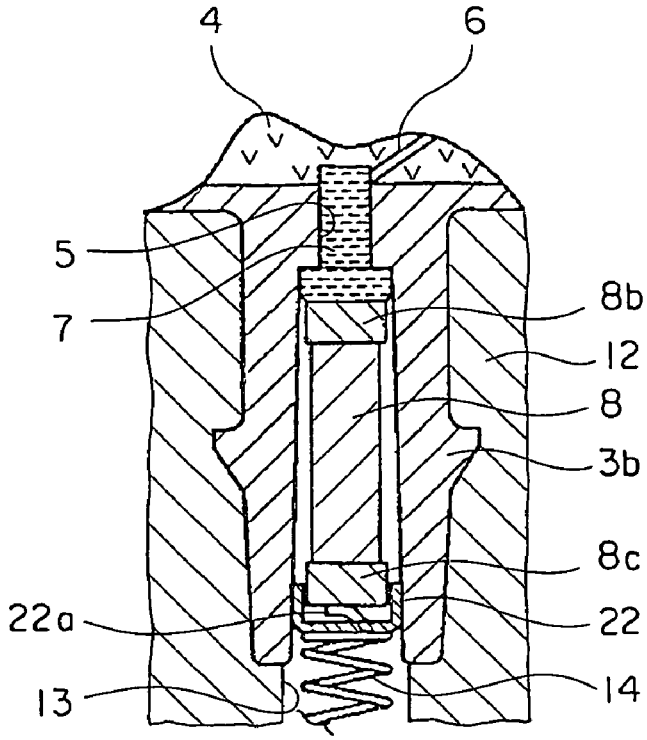
FIG. 3 is a cross-sectional view showing an essential part of an ignition device for an internal combustion engine according to a third embodiment of the present invention.
Figure 4:
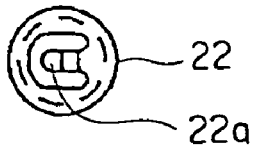
FIG. 4 shows a bottom face portion of a conductive cap of FIG. 3.

FIG. 3 is a cross-sectional view showing an essential part of an ignition device for an internal combustion engine according to a third embodiment of the present invention. FIG. 4 is a bottom view of a conductive cap 22 of FIG. 3.

In this embodiment, the conductive cap 22, which assumes a cylindrical shape with a closed bottom, has a tongue strip 22*a* as an elastic portion abutting on the noise-suppressing resistor 8 and urging the noise-suppressing resistor 8 toward the high-voltage connection terminal 7. Due to an elastic force of the tongue strip 22*a*, the electrode 8*b* of the noise-suppressing resistor 8 is in face-to-face contact with the high-voltage connection terminal 7.

As is the case with the conductive cap 21 of the second embodiment, the conductive cap 22 is press-fitted into the end portion of the high-tension tower 3*b* on the other side of the opening portion 5. The conductive cap 22 on which the end portion of the spring 14 abuts has an inner diameter dimension that is slightly larger than the outer diameter dimension of the electrode 8*c* of the noise-suppressing resistor 8.

The ignition device for the internal combustion engine according to the third embodiment is similar to that of the second embodiment in terms of other constructional details.

In the ignition device according to the third embodiment, which achieves an operation and an effect similar to those achieved by the ignition device according to the second embodiment, the electrode 8*b* of the noise-suppressing resistor 8 is reliably in face-to-face contact with the high-voltage connection terminal 7 due to an elastic force of the tongue strip 22*a* of the conductive cap 22. Accordingly, the high-voltage connection terminal 7 and the noise-suppressing resistor 8 are electrically connected to each other reliably, and the auxiliary spring 30 required in the second embodiment is unnecessary. As a result, the number of components is reduced in comparison with the second embodiment.

Fourth Embodiment

Figure 5:
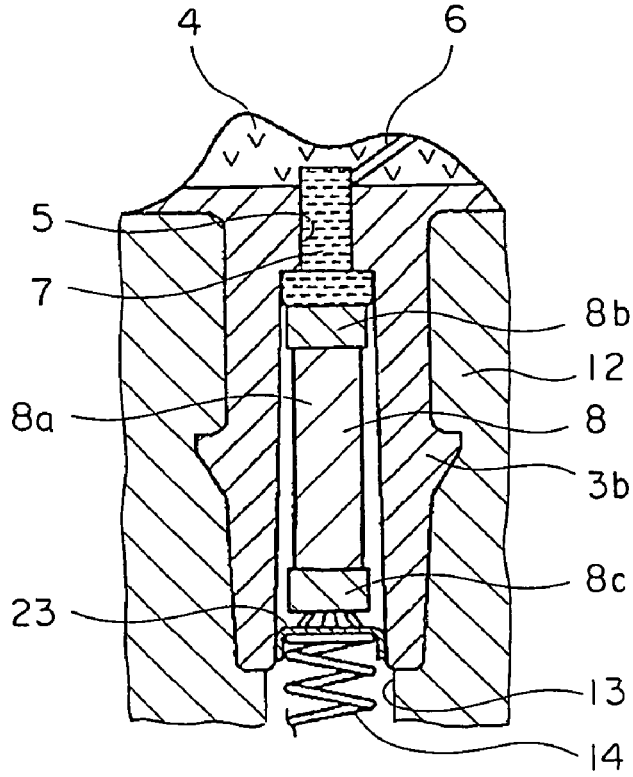
FIG. 5 is a cross-sectional view showing an essential part of an ignition device for an internal combustion engine according to a fourth embodiment of the present invention.
Figure 6:
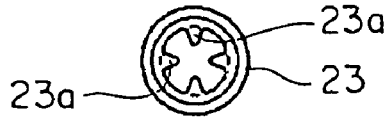
FIG. 6 shows a bottom face portion of a conductive cap of FIG. 5.

FIG. 5 is a cross-sectional view showing an essential part of an ignition device for an internal combustion engine according to a fourth embodiment of the present invention. FIG. 6 is a bottom view of a conductive cap 23 of FIG. 5.

In this embodiment, the conductive cap 23, which assumes a cylindrical shape with a closed bottom, has tiny strips 23*a* as elastic portions abutting on the noise-suppressing resistor 8 and urging the noise-suppressing resistor 8 toward the high-voltage connection terminal 7. Due to elastic forces of the four tiny strips 23*a* that stand inclined toward the noise-suppressing resistor 8, the electrode 8*b* of the noise-suppressing resistor 8 is in face-to-face contact with the high-voltage connection terminal 7.

As is the case with the conductive cap 21 of the second embodiment, the conductive cap 23 is press-fitted in the end portion of the high-tension tower 3*b* on the other side of the opening portion 5. The end portion of the spring 14 is press-fitted in the conductive cap 23, so that the spring 14 is prevented from being radially displaced.

The ignition device for the internal combustion engine according to the fourth embodiment is similar to that of the second embodiment in terms of other constructional details.

In the ignition device according to the fourth embodiment, which achieves an operation and an effect similar to those achieved by the ignition device according to the second embodiment, the electrode 8*b* of the noise-suppressing resistor 8 is reliably in face-to-face contact with the high-voltage connection terminal 7 due to an elastic force of the tiny strip 23*a* of the conductive cap 23. Accordingly, the high-voltage connection terminal 7 and the noise-suppressing resistor 8 are electrically connected to each other reliably, and the auxiliary spring 30 required in the second embodiment is unnecessary. As a result, the number of components is reduced in comparison with the second embodiment similarly to the third embodiment.

Fifth Embodiment

Figure 7:
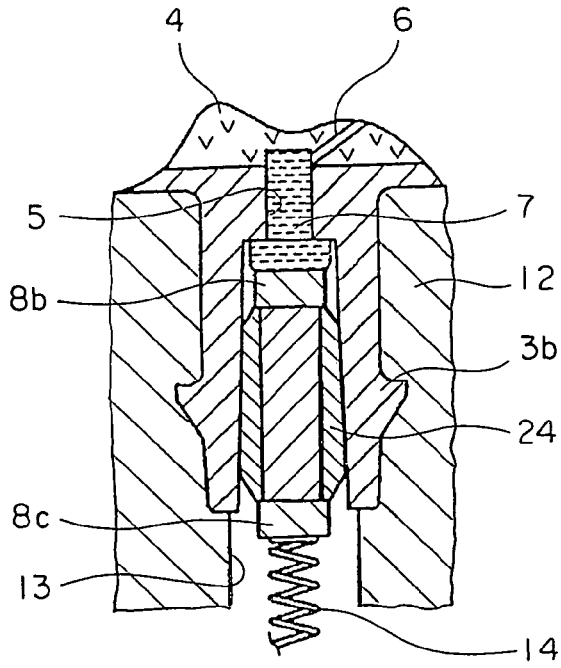
FIG. 7 is a cross-sectional view showing an essential part of an ignition device for an internal combustion engine according to a fifth embodiment of the present invention.

FIG. 7 is a cross-sectional view showing an essential part of an ignition device for an internal combustion engine according to a fifth embodiment of the present invention.

In this embodiment, a cylindrical cover 24 made of insulating rubber is fittingly attached to the noise-suppressing resistor 8.

The ignition device for the internal combustion engine according to this embodiment, in which the easily damageable ceramic noise-suppressing resistor 8 is covered with the cover 24, is easier to handle as a single article.

Before the noise-suppressing resistor 8 is inserted into the high-tension tower 3*b*, the outer diameter dimension of the cover 24 is slightly larger than the inner diameter dimension of the high-tension tower 3*b*. Therefore, the noise-suppressing resistor 8 is reliably positioned within the high-tension tower 3*b* by press-fitting the noise-suppressing resistor 8 covered with the cover 24 into the high-tension tower 3*b*. Accordingly, there is no fear that the noise-suppressing resistor 8 will be damaged after, for example, falling off by mistake before the high-tension tower 3*b* is inserted into the plug boot 12.

The operation of press-fitting the noise-suppressing resistor 8 is easily performed by press-fitting it along an inner wall surface of the high-tension tower 3*b*.

The cover and the noise-suppressing resistor may be integrated with each other by insert molding, using insulating resin. It is also appropriate to mold the cylindrical cover made of insulating resin and fittingly attach the cover to an outer peripheral surface of the noise-suppressing resistor. Unlike the cover 24 made of insulating rubber, however, the cover made of resin does not exhibit elasticity. In order to ensure smooth insertion of the cover into the high-tension tower, therefore, the outer diameter dimension of the cover needs to be set substantially equal to the inner diameter dimension of the high-tension tower.

As regards the shape of the cover, a plurality of axially extending ribs may be circumferentially arranged at intervals of a certain distance along a cylindrical outer wall surface of the cover. Alternatively, the cover may be, for example, rectangular or star-shaped in cross-section.

Sixth Embodiment

Figure 8:
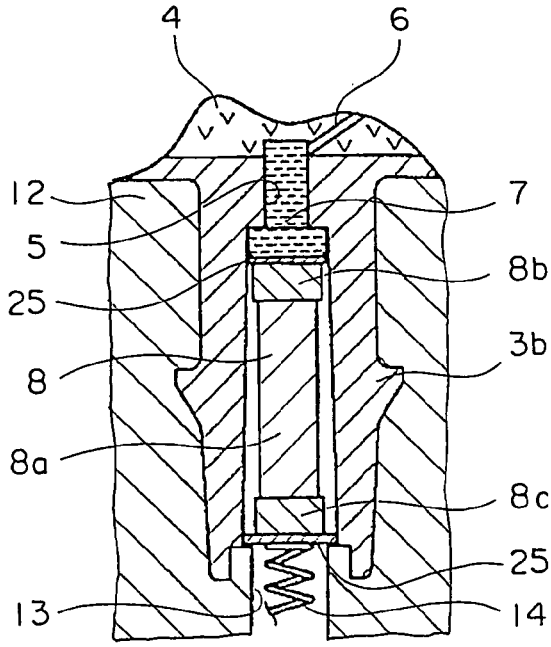
FIG. 8 is a cross-sectional view showing an essential part of an ignition device for an internal combustion engine according to a sixth embodiment of the present invention.

FIG. 8 is a cross-sectional view showing an essential part of an ignition device for an internal combustion engine according to a sixth embodiment of the present invention.

In this embodiment, abrasion preventing plates 25, which prevent the noise-suppressing resistor 8 from being abraded by the high-voltage connection terminal 7 and the spring 14 respectively, are provided between the electrode 8*b* of the noise-suppressing resistor 8 and the high-voltage connection terminal 7 and between the electrode 8*c* of the noise-suppressing resistor 8 and the spring 14, respectively.

The ignition device for the internal combustion engine according to the sixth embodiment is similar to that of the first embodiment in terms of other constructional details.

In the ignition device for the internal combustion engine, when the electrode 8*b* constructed as a metal cap is in direct contact with the high-voltage connection terminal 7 and when the electrode 8*c* constructed as a metal cap is in direct contact with the spring 14, there is a fear that respective contact faces will be abraded due to, for example, oscillation of the entire device.

On the other hand, according to the ignition device for the internal combustion engine of this embodiment, the amounts of abrasion of the electrodes 8*b* and 8*c*, the high-voltage connection terminal 7, and the spring 14 are reduced by providing the abrasion preventing plates 25 that have smooth surfaces and exhibit great hardness.

It is also appropriate to provide one of the abrasion preventing plates 25 only between the electrode 8*b* of the noise-suppressing resistor 8 and the high-voltage connection terminal 7 or between the electrode 8*c* of the noise-suppressing resistor 8 and the spring 14.

The abrasion preventing plates 25 are also applicable to the ignition device for the internal combustion engine according to each of the second to fifth embodiments.

Seventh Embodiment

Figure 9:
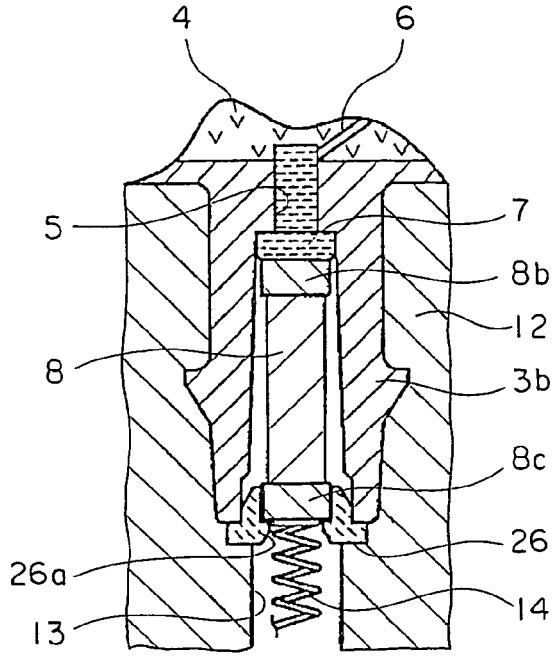
FIG. 9 is a cross-sectional view showing an essential part of an ignition device for an internal combustion engine according to a seventh embodiment of the present invention.

FIG. 9 is a cross-sectional view showing an essential part of an ignition device for an internal combustion engine according to a seventh embodiment of the present invention.

In this embodiment, an insulating cap 26 made of resin, which prevents the noise-suppressing resistor 8 from falling off from the high-tension tower 3*b*, is fixed to the end portion of the high-tension tower 3*b* on the other side of the opening portion 5, using an adhesive. A hole 26*a* is formed in a central portion of the insulating cap 26, and the end portion of the spring 14 penetrates the hole 26*a*.

The end portion of the spring 14 abuts on the electrode 8*c* of the noise-suppressing resistor 8 through the hole 26*a* and is electrically connected thereto.

The electrode 8*c* is accommodated in a depression portion of the insulating cap 26. The depression portion has an inner diameter dimension that is slightly larger than the outer diameter dimension of the electrode 8*c* of the noise-suppressing resistor 8.

It is also appropriate that the insulating cap 26 is press-fitted into the end portion of the high-tension tower 3*b* and fixed thereto.

The ignition device for the internal combustion engine according to the seventh embodiment is similar to that of the third embodiment in terms of other constructional details.

In the ignition device for the internal combustion engine according to this embodiment, as is the case with that of the third embodiment, there is no fear that the noise-suppressing resistor 8 will be damaged after, for example, falling off by mistake when the high-tension tower 3*b* is inserted into the plug boot 12 or when the high-tension tower 3*b* is drawn out from the plug boot 12.

The inner diameter dimension of the insulating cap 26 is slightly larger than the outer diameter dimension of the electrode 8*c* of the noise-suppressing resistor 8, which is radially freely movable slightly with respect to the insulating cap 26. Accordingly, when the high-tension tower 3*b* receives an impact from outside in, for example, press-fitting the insulating cap 26 into the end portion of the high-tension tower 3*b* or mounting the high-tension tower 3*b* to the plug boot 12, the impact is restrained from being directly transmitted to the noise-suppressing resistor 8. The magnitude of damage to the noise-suppressing resistor 8 resulting from the impact is reduced.

Eighth Embodiment

Figure 10:
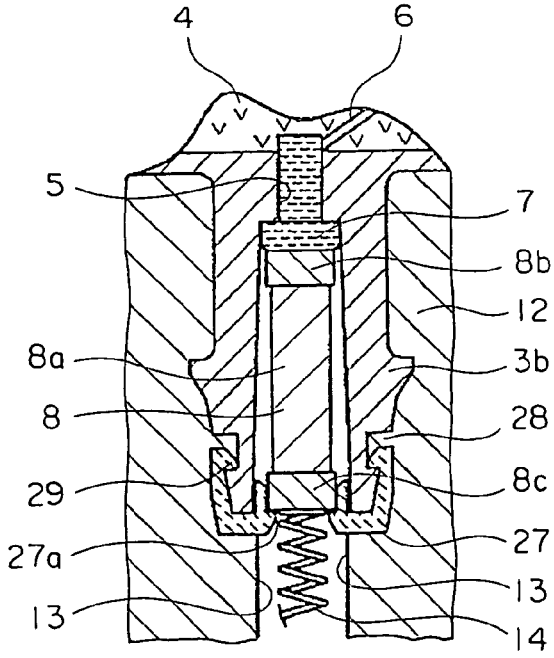
FIG. 10 is a cross-sectional view showing an essential part of an ignition device for an internal combustion engine according to an eighth embodiment of the present invention.

FIG. 10 is a cross-sectional view showing an essential part of an ignition device for an internal combustion engine according to an eighth embodiment of the present invention.

In this embodiment, an engaged groove 28 is formed in a lateral surface of the end portion of the high-tension tower 3*b*, and a hook-shaped engaging portion 29 engaging the engaged groove 28 is formed in an insulating cap 27.

The ignition device for the internal combustion engine according to the eighth embodiment is similar to that of the seventh embodiment in terms of other constructional details.

The ignition device according to this embodiment can achieve an operation and an effect similar to those achieved by the ignition device according to the seventh embodiment. Furthermore, the insulating cap 27 can be easily removed from the high-tension tower 3*b* by disengaging the engaging portion 29 of the insulating cap 27 from the engaged groove 28. This produces an effect of facilitating an operation of replacing the noise-suppressing resistor 8.

Ninth Embodiment

Figure 11:
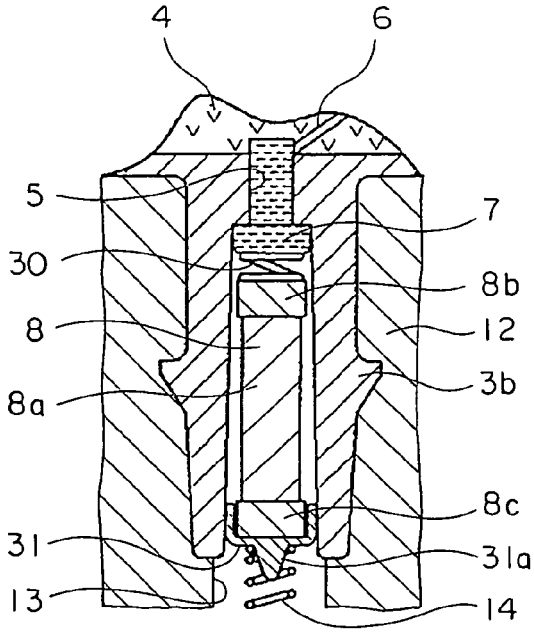
FIG. 11 is a cross-sectional view showing an essential part of an ignition device for an internal combustion engine according to a ninth embodiment of the present invention.

FIG. 11 is a cross-sectional view showing an essential part of an ignition device for an internal combustion engine according to a ninth embodiment of the present invention.

In this embodiment, a protruding portion 31*a* that protrudes on the spring 14 side and restricts radial movements of the spring 14 is formed in a conductive cap 31.

The ignition device for the internal combustion engine according to the ninth embodiment is similar to that of the second embodiment in terms of other constructional details.

The ignition device according to this embodiment can achieve an operation and an effect similar to those achieved by the ignition device according to the second embodiment. Furthermore, the protruding portion 31*a* of the conductive cap 31 restricts radial movements of the end portion of the spring 14, which is easily positioned with respect to the conductive cap 31.

Tenth Embodiment

Figure 12:
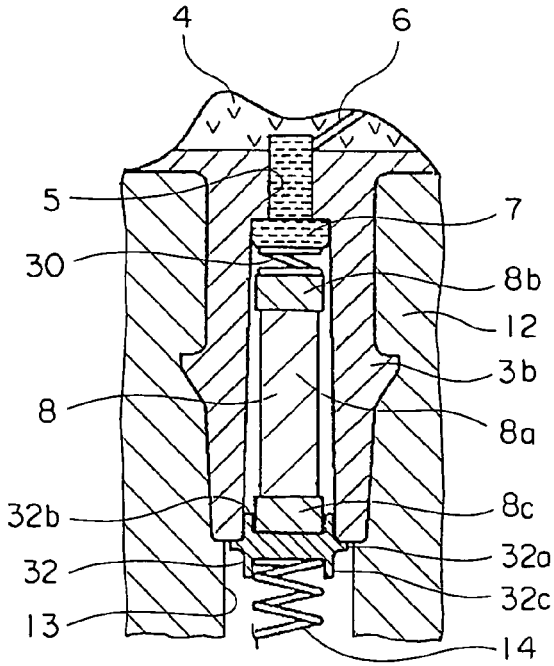
FIG. 12 is a cross-sectional view showing an ignition device for an internal combustion engine according to a tenth embodiment of the present invention.

FIG. 12 is a cross-sectional view showing an essential part of an ignition device for an internal combustion engine according to a tenth embodiment of the present invention.

In this embodiment, a radially protruding flange portion 32*a*, a flange portion 32*b* protruding on the noise-suppressing resistor 8 side, and a flange portion 32*c* protruding on the spring 14 side are formed in a conductive cap 32 respectively.

The flange portion 32*a* has a function of positioning the flange portion 32*b* of the conductive cap 32 when it is press-fitted into the end portion of the high-tension tower 3*b*, and the flange portion 32*c* has a function of restricting radial movements of the spring 14.

The flange portion 32*b* of the conductive cap 32 has an inner diameter dimension that is slightly larger than the outer diameter dimension of the electrode 8*c* of the noise-suppressing resistor 8, which is radially freely movable slightly with respect to the insulating cap 32.

The ignition device for the internal combustion engine according to the tenth embodiment is similar to that of the ninth embodiment in other constructional details.

The ignition device according to this embodiment can achieve an operation and an effect similar to those achieved by the ignition device according to the second embodiment. Furthermore, the flange portion 32*c* of the conductive cap 32 restricts radial movements of the end portion of the spring 14, which is easily positioned with respect to the conductive cap 32.

In the description of the ignition device for the internal combustion engine according to each of the embodiments, the noise-suppressing resistor 8 is used as the transformer output voltage control element. However, the present invention is applicable even to a case where a high-voltage diode that suppresses a counterelectromotive force generated in the secondary winding in activating the transformer is used as the transformer output voltage control element.

The high-voltage diode in this case assumes, for example, a cylindrical shape. One end portion of the high-voltage diode is electrically connected to the high-voltage connection terminal, and the other end portion of the high-voltage diode is in contact with the spring.

In the ignition device for the internal combustion engine according to each of the embodiments except the fifth embodiment, there is a gap formed between the high-tension tower 3*b* and the noise-suppressing resistor 8. By providing elastic synthetic rubber in the gap of the ignition device for the internal combustion engine according to each of the embodiments, radial oscillations transmitted to the noise-suppressing resistor 8 can be suppressed.

Figure 13:
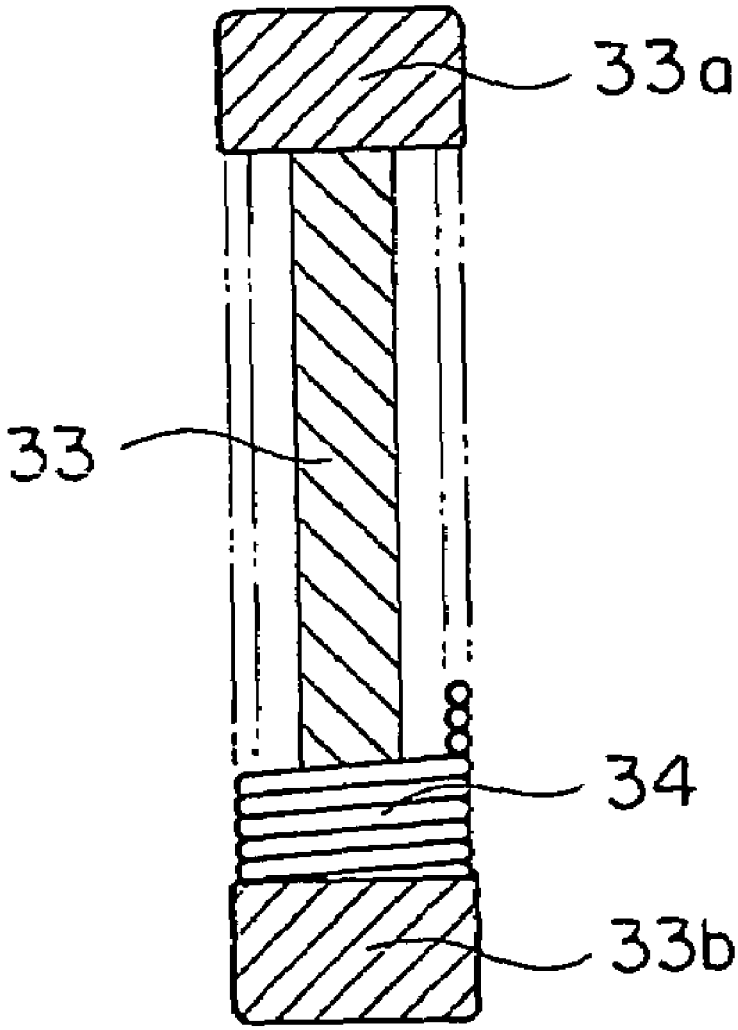
FIG. 13 is a cross-sectional view showing a noise-suppressing resistor according to an example different from those of the first to tenth embodiments.

In the description of the ignition device for the internal combustion engine according to each of the embodiments, the ceramic noise-suppressing resistor 8 is used. However, the present invention is applicable even when a noise-suppressing resistor that is composed of a mandrel 33, electrodes 33*a* and 33*b* provided at both ends of the mandrel 33 respectively, and a resistance wire 34 wound around the mandrel 33 as shown in FIG. 13 is used.

What is claimed is:

1. An ignition device for an internal combustion engine comprising:

a transformer having a primary winding and a secondary winding;

a case composed of a case body (3*a*) receiving the transformer, and a high-tension tower having an opening portion, the case body and the high-tension tower communicating with each other through the opening portion;

a plug boot fittingly attached to the high-tension tower;

a cast insulating resin injected into the case body and cured to insulate and fix the transformer;

a high-voltage connection terminal connected to one end of the secondary winding and closes the opening portion so that the cast insulating resin that has not been cured is prevented from entering the high-tension tower;

a transformer output voltage control element received in the high-tension tower, which is electrically connected to the high-voltage connection terminal, and controls a voltage generated in the second winding in activating the transformer; and a spring provided in a through-hole of the plug boot, between the transformer output voltage control element and a spark plug, which electrically connects the transformer output voltage control element and the spark plug to each other, and urges the transformer output voltage control element toward the high-voltage connection terminal.

2. An ignition device for an internal combustion engine according to claim 1, wherein the high-tension tower on the other side of the opening portion is provided with a conductive cap provided at an end portion thereof which prevents the transformer output voltage control clement from falling off from the high-tension tower and abuts on an end portion of the spring.

3. An ignition device for an internal combustion engine according to claim 2, wherein the conductive cap comprises an elastic portion that abuts on the transformer output voltage control element and urges the transformer output voltage control element toward the high-voltage connection terminal.

4. An ignition device for an internal combustion engine according to claim 2, wherein the conductive cap comprises a protruding portion formed thereon, which protrudes on the spring side to restrict radial movements of the spring.

5. An ignition device for an internal combustion engine according to claim 2, wherein the conductive cap comprises a flange portion formed thereto, which restricts radial movements of at least one of the transformer output voltage control element and the spring.

6. An ignition device for an internal combustion engine according to claim 1, wherein the end portion of the high-tension tower on the other side of the opening portion is provided with an insulating cap that prevents the transformer output voltage control element from falling off from the high-tension tower and has a hole penetrated by the end portion of the spring.

7. An ignition device for an internal combustion engine according to claim 6, wherein the high-tension tower comprises an engaged groove formed in a lateral surface of the end portion thereof, and wherein the insulating cap comprises an engaging portion that engages the engaged groove.

8. An ignition device for an internal combustion engine according to claim 1, wherein a cover that prevents the transformer output voltage control element from being damaged and positions the transformer output voltage control element within the high-tension tower is provided between a peripheral surface of the transformer output voltage control element and an inner wail surface of the high-tension tower.

9. An ignition device for an internal combustion engine according to claim 1, wherein an abrasion preventing plate that prevents the transformer output voltage control element from being abraded by the high-voltage connection terminal or the spring is provided at least one of between one end portion of the transformer output voltage control element and the high-voltage connection terminal and between the other end portion of the transformer output voltage control element and the spring.

10. An ignition device for an internal combustion engine according to claim 1, wherein a non-curable synthetic rubber exhibiting elasticity is provided in a gap between a peripheral surface of the transformer output voltage control element and an inner wall surface of the high-tension tower.

11. An ignition device for an internal combustion engine according to claim 1, wherein the transformer output voltage control element is a noise-suppressing resistor that suppresses electrical noise generated at a time of a discharge in the spark plug.

12. An ignition device for an internal combustion engine according to claim 1, wherein the transformer output voltage control element is a high-voltage diode that suppresses a counterelectromotive force generated in the secondary winding.

13. An ignition device for an internal combustion engine according to claim 11, wherein the noise-suppressing resistor comprises a cylindrical ceramic body and electrodes provided at both ends of the body respectively.

14. An ignition device for an internal combustion engine according to claim 11, wherein the noise-suppressing resistor comprises a mandrel, electrodes provided at both ends of the mandrel respectively, and a resistance wire wound around the mandrel.

* * * * *